US007290679B2

(12) United States Patent
Hechmati

(10) Patent No.: US 7,290,679 B2
(45) Date of Patent: Nov. 6, 2007

(54) FOLDABLE AIR INSULATING SLEEVE

(76) Inventor: Laurent Hechmati, 10697 Somma Way, Los Angeles, CA (US) 90077

( * ) Notice: Subject to any disclaimer, the term of this patent is extended or adjusted under 35 U.S.C. 154(b) by 361 days.

(21) Appl. No.: 10/459,337

(22) Filed: Jun. 11, 2003

(65) Prior Publication Data

US 2004/0251262 A1 Dec. 16, 2004

(51) Int. Cl.
*B65D 25/00* (2006.01)

(52) U.S. Cl. ..... 220/739; 220/737

(58) Field of Classification Search ..... 220/737, 220/738, 739, 903; 206/427, 428, 446, 486, 206/514; 229/403, 405; 383/3
See application file for complete search history.

(56) References Cited

U.S. PATENT DOCUMENTS

| | | | | |
|---|---|---|---|---|
| 2,483,168 | A * | 9/1949 | Amberg | 220/1.5 |
| 3,337,109 | A * | 8/1967 | Shumrak | 220/738 |
| 3,908,523 | A | 9/1975 | Shikaya | 93/36.01 |
| 3,977,562 | A | 8/1976 | Wedzik | 220/270 |
| 3,994,411 | A | 11/1976 | Elfelt et al. | 220/90.4 |
| D243,231 | S | 2/1977 | Smith | D9/267 |
| 4,056,210 | A | 11/1977 | Boyle | 220/90.4 |
| 4,074,827 | A * | 2/1978 | Labe, III | 220/522 |
| 4,090,660 | A | 5/1978 | Schram et al. | 229/43 |
| 4,106,660 | A | 8/1978 | Boyle | 220/90.4 |
| 4,117,971 | A | 10/1978 | Itoh | 229/1.5 |
| 4,183,443 | A | 1/1980 | DeParales et al. | 220/90.4 |
| 4,183,444 | A | 1/1980 | English et al. | 220/200 |
| 4,186,842 | A | 2/1980 | Albert | 220/206 |
| D256,887 | S | 9/1980 | Swade et al. | D9/267 |
| D256,888 | S | 9/1980 | Swade et al. | D9/267 |
| D256,889 | S | 9/1980 | Swade et al. | D9/267 |
| 4,261,501 | A | 4/1981 | Watkins et al. | 229/1.5 |
| 4,280,652 | A | 7/1981 | Schmidt | 229/43 |
| 4,285,442 | A | 8/1981 | Wedzik | 220/270 |
| 4,288,026 | A | 9/1981 | Wilhelm | 229/1.5 |
| 4,303,170 | A | 12/1981 | Panicci | 220/70 |
| 4,319,691 | A | 3/1982 | Hament | 220/90.4 |
| 4,322,015 | A | 3/1982 | Bailey | 220/90.2 |
| 4,345,695 | A | 8/1982 | Galloway, deceased et al. | 220/254 |
| 4,388,996 | A | 6/1983 | Panicci | 220/70 |
| 4,394,905 | A * | 7/1983 | Hackenberg | 206/486 |
| D271,857 | S | 12/1983 | Callahan | D9/438 |
| 4,421,244 | A | 12/1983 | Van Melle | 220/306 |
| 4,428,498 | A | 1/1984 | Obey | 220/367 |
| 4,438,865 | A | 3/1984 | Scattaregia | 220/270 |
| RE31,650 | E | 8/1984 | Serritella | 229/7 R |

(Continued)

*Primary Examiner*—Anthony D. Stashick
*Assistant Examiner*—Harry A Grosso
(74) *Attorney, Agent, or Firm*—Kirton & McConkie; Michael F. Krieger

(57) ABSTRACT

A foldable air insulating sleeve for insulating beverage and food containers is herein provided. More particularly, the foldable air insulating sleeve secures a cup in a manner that leaves a pocket of air surrounding the cup. This provides for improved temperature regulation and sufficient thermal insulation to assist the user in firmly grasping and handling the cup despite excess heat or condensation caused by the temperature of the cup's contents. Because the bases of most disposable cups are narrower than their respective rims, more air and thus greater insulation is found towards the bottom of cups secured by foldable air insulating sleeves. The wider base also gives such cups more stability. Printable material can also be affixed on the foldable air insulating sleeve's outer surface for advertising or other purposes. Some embodiments of the foldable air insulating sleeve include a lid to further improve thermal insulation.

14 Claims, 14 Drawing Sheets

U.S. PATENT DOCUMENTS

| | | | | | |
|---|---|---|---|---|---|
| 4,473,167 | A | | 9/1984 | Bailey | 220/90.4 |
| 4,502,608 | A | | 3/1985 | Mills | 220/90.4 |
| 4,503,992 | A | | 3/1985 | Sitko et al. | 220/90.4 |
| 4,518,096 | A | | 5/1985 | Winstead | 220/268 |
| 4,548,349 | A | | 10/1985 | Tunberg | 229/1.5 H |
| 4,573,631 | A | | 3/1986 | Reeves | 229/7 S |
| 4,582,214 | A | | 4/1986 | Dart et al. | 220/90.4 |
| 4,586,625 | A | | 5/1986 | Garrett | 220/266 |
| 4,589,569 | A | | 5/1986 | Clements | 220/380 |
| D284,563 | S | | 7/1986 | Merino | D9/451 |
| 4,615,459 | A | | 10/1986 | Clements | 220/254 |
| 4,631,715 | A | | 12/1986 | Hoover | 369/68 |
| 4,632,273 | A | | 12/1986 | Rhine | 220/441 |
| D287,919 | S | | 1/1987 | Clements | D7/40 |
| D292,676 | S | | 11/1987 | Mileto | D9/454 |
| 4,712,725 | A | | 12/1987 | Moore | 229/8 |
| 4,715,633 | A | | 12/1987 | Brink et al. | 294/31.2 |
| 4,726,487 | A | | 2/1988 | Mitri | 220/90.2 |
| 4,726,553 | A | | 2/1988 | Wischusen, III | 248/146 |
| 4,738,373 | A | | 4/1988 | DeParales | 220/254 |
| 4,741,450 | A | | 5/1988 | Braude | 220/90.4 |
| 4,753,365 | A | | 6/1988 | Seppala | 220/90.4 |
| 4,756,440 | A | | 7/1988 | Gartner | 220/90.4 |
| 4,767,019 | A | | 8/1988 | Horner | 220/90.4 |
| D299,010 | S | | 12/1988 | Wall | D9/454 |
| 4,791,030 | A | | 12/1988 | DeMars | 428/542.4 |
| 4,795,052 | A | | 1/1989 | Hayes, Jr. | 220/90.4 |
| 4,877,151 | A | | 10/1989 | Rush et al. | 206/514 |
| 4,898,299 | A | | 2/1990 | Herbst et al. | 220/90.4 |
| 4,915,250 | A | | 4/1990 | Hayes, Jr. | 220/90.4 |
| 4,919,381 | A | | 4/1990 | Buist | 248/154 |
| 4,925,051 | A | | 5/1990 | Herbst | 220/90.4 |
| 4,934,558 | A | | 6/1990 | Vargas | 220/287 |
| 4,978,024 | A | | 12/1990 | Newman et al. | 220/90.4 |
| 4,997,156 | A | | 3/1991 | Allen | 248/311.2 |
| 5,050,759 | A | | 9/1991 | Marble | 220/90 |
| D320,560 | S | | 10/1991 | Allen | D9/438 |
| 5,065,880 | A | | 11/1991 | Horner | 220/711 |
| 5,079,013 | A | | 1/1992 | Belanger | 426/115 |
| 5,090,584 | A | | 2/1992 | Roberts et al. | 220/712 |
| 5,092,485 | A | | 3/1992 | Lee | 220/441 |
| 5,111,961 | A | | 5/1992 | Van Melle | 220/712 |
| 5,145,107 | A | | 9/1992 | Silver et al. | 229/1.5 |
| 5,147,065 | A | | 9/1992 | Rush et al. | 220/709 |
| 5,147,066 | A | | 9/1992 | Snider | 220/717 |
| 5,197,624 | A | | 3/1993 | Dodaro | 220/254 |
| 5,205,473 | A | | 4/1993 | Coffin, Sr. | 229/1.5 B |
| 5,222,656 | A | | 6/1993 | Carlson | 229/1.5 H |
| 5,226,585 | A | | 7/1993 | Varano | 229/1.5 |
| D339,027 | S | | 9/1993 | Mack et al. | D7/392.1 |
| 5,253,781 | A | | 10/1993 | Van Melle et al. | 220/713 |
| 5,259,529 | A | * | 11/1993 | Coale | 220/739 |
| 5,326,019 | A | | 7/1994 | Wolff | 229/1.5 |
| 5,348,181 | A | | 9/1994 | Smith et al. | 220/254 |
| 5,361,935 | A | | 11/1994 | Saguccio | 220/709 |
| 5,363,982 | A | | 11/1994 | Sadlier | 220/441 |
| 5,375,828 | A | | 12/1994 | Shikami | 273/110 |
| D355,846 | S | | 2/1995 | Denney et al. | D9/449 |
| 5,392,949 | A | | 2/1995 | McKenna | 220/712 |
| 5,397,023 | A | | 3/1995 | Toczek et al. | 220/709 |
| 5,398,843 | A | | 3/1995 | Warden et al. | 220/711 |
| D358,294 | S | | 5/1995 | Letica | D7/392.1 |
| 5,415,002 | A | | 5/1995 | Koenig | 62/63 |
| 5,415,312 | A | | 5/1995 | Mueller | 220/254 |
| 5,415,339 | A | | 5/1995 | Howard | 229/403 |
| 5,425,497 | A | | 6/1995 | Sorensen | 220/738 |
| 5,431,276 | A | | 7/1995 | Lialin | 206/222 |
| D361,469 | S | | 8/1995 | Young | D7/392.1 |
| 5,445,315 | A | * | 8/1995 | Shelby | 229/117.06 |
| 5,454,484 | A | | 10/1995 | Chelossi | 220/738 |
| 5,460,286 | A | | 10/1995 | Rush et al. | 220/306 |
| D363,852 | S | | 11/1995 | Young | D7/392.1 |
| 5,465,891 | A | | 11/1995 | Bridges | 224/566 |
| 5,469,983 | A | | 11/1995 | Yawata | 220/412 |
| 5,485,938 | A | | 1/1996 | Boersma | 220/714 |
| 5,490,609 | A | | 2/1996 | Lane et al. | 220/712 |
| 5,492,269 | A | | 2/1996 | Sung | 229/117.06 |
| D368,624 | S | | 4/1996 | Forrer | D7/392.1 |
| 5,509,568 | A | | 4/1996 | Warden et al. | 220/711 |
| 5,529,202 | A | | 6/1996 | Shamis | 220/301 |
| 5,538,180 | A | | 7/1996 | Lo | 229/405 |
| 5,542,599 | A | | 8/1996 | Sobol | 229/403 |
| 5,579,949 | A | | 12/1996 | Dykes et al. | 220/739 |
| 5,588,552 | A | | 12/1996 | Johnson | 220/712 |
| 5,613,619 | A | | 3/1997 | Van Melle | 220/712 |
| 5,624,053 | A | | 4/1997 | Freek et al. | 220/713 |
| 5,628,453 | A | | 5/1997 | MacLaughlin | 229/403 |
| D379,738 | S | | 6/1997 | Liming et al. | D7/511 |
| D379,928 | S | | 6/1997 | Freek et al. | D9/447 |
| D381,267 | S | | 7/1997 | Rush et al. | D9/452 |
| D381,268 | S | | 7/1997 | Rush et al. | D9/452 |
| 5,657,898 | A | | 8/1997 | Portman et al. | 220/712 |
| 5,660,326 | A | | 8/1997 | Varano et al. | 229/441 |
| 5,667,135 | A | | 9/1997 | Schaefer | 229/403 |
| 5,669,553 | A | | 9/1997 | Smith | 229/403 |
| 5,676,306 | A | | 10/1997 | Lankin et al. | 229/404 |
| 5,678,720 | A | | 10/1997 | Van Melle | 220/287 |
| 5,685,480 | A | | 11/1997 | Choi | 229/403 |
| 5,692,616 | A | | 12/1997 | Baker | 206/449 |
| 5,697,550 | A | | 12/1997 | Varano et al. | 229/403 |
| 5,699,927 | A | | 12/1997 | Lane et al. | 220/254 |
| 5,702,024 | A | | 12/1997 | Riso | 220/704 |
| 5,706,972 | A | | 1/1998 | Sousa | 220/714 |
| 5,713,512 | A | | 2/1998 | Barrett | 229/403 |
| 5,746,372 | A | | 5/1998 | Spence | 229/403 |
| 5,752,653 | A | | 5/1998 | Razzaghi | 229/403 |
| RE35,830 | E | | 6/1998 | Sadlier | 220/441 |
| 5,765,716 | A | | 6/1998 | Cai et al. | 220/740 |
| 5,769,311 | A | | 6/1998 | Morita et al. | 229/403 |
| 5,772,069 | A | | 6/1998 | Price | 220/737 |
| 5,772,111 | A | | 6/1998 | Kirsch | 229/403 |
| 5,791,509 | A | | 8/1998 | Rush et al. | 220/781 |
| 5,794,843 | A | | 8/1998 | Sanchez | 229/403 |
| 5,820,016 | A | | 10/1998 | Stropkay | 229/403 |
| 5,839,601 | A | | 11/1998 | Van Melle | 220/712 |
| 5,839,653 | A | | 11/1998 | Zadravetz | 229/403 |
| 5,842,633 | A | | 12/1998 | Nurse | 229/403 |
| 5,845,806 | A | * | 12/1998 | Parchman | 220/739 |
| 5,894,952 | A | | 4/1999 | Mendenhall et al. | 220/713 |
| 5,934,501 | A | | 8/1999 | Wright et al. | 220/528 |
| 5,947,323 | A | | 9/1999 | Freek et al. | 220/709 |
| 5,952,068 | A | | 9/1999 | Neale et al. | 428/36.5 |
| D415,654 | S | | 10/1999 | Forrer | D7/510 |
| 5,964,400 | A | | 10/1999 | Varano et al. | 229/403 |
| D417,360 | S | | 12/1999 | Bickert et al. | D7/392.1 |
| 5,996,837 | A | | 12/1999 | Freek et al. | 220/713 |
| 6,003,711 | A | | 12/1999 | Bilewitz | 220/253 |
| D418,363 | S | | 1/2000 | Barnes et al. | D7/392 |
| 6,047,852 | A | | 4/2000 | Evans et al. | 220/793 |
| 6,050,445 | A | | 4/2000 | Manganiello | 220/714 |
| 6,053,352 | A | | 4/2000 | Cai | 20/739 |
| 6,056,144 | A | | 5/2000 | Strange et al. | 220/297 |
| 6,059,140 | A | * | 5/2000 | Hicks | 220/739 |
| 6,070,755 | A | | 6/2000 | Evans et al. | 220/793 |
| 6,076,450 | A | | 6/2000 | DiGiorgio, Jr. | 99/298 |
| 6,085,970 | A | | 7/2000 | Sadlier | 229/403 |
| 6,089,397 | A | | 7/2000 | Van Melle | 220/270 |
| D429,443 | S | | 8/2000 | D=Alessio | D7/392.1 |
| 6,102,245 | A | | 8/2000 | Haberman | 220/714 |
| 6,129,653 | A | | 10/2000 | Fredricks et al. | 493/110 |
| 6,138,862 | A | | 10/2000 | Tai | 220/592.17 |
| 6,139,665 | A | | 10/2000 | Schmelzer et al. | 156/78 |
| 6,142,335 | A | | 11/2000 | Query, Jr. | 220/707 |
| 6,152,363 | A | | 11/2000 | Rule, Jr. | 229/403 |

| | | | | |
|---|---|---|---|---|
| 6,176,390 | B1 | 1/2001 | Kemp | 220/712 |
| 6,176,420 | B1 | 1/2001 | Sarson et al. | 229/128 |
| 6,182,855 | B1 | 2/2001 | Alpert | 220/739 |
| 6,196,454 | B1 | 3/2001 | Sadlier | 229/403 |
| 6,207,100 | B1 | 3/2001 | Weiss et al. | 264/553 |
| 6,230,924 | B1 | 5/2001 | Weiss et al. | 220/713 |
| 6,250,545 | B1 | 6/2001 | Mazzarolo et al. | 229/403 |
| 6,253,995 | B1 | 7/2001 | Blok et al. | 229/403 |
| 6,257,485 | B1 | 7/2001 | Sadlier et al. | 229/403 |
| 6,260,727 | B1 | 7/2001 | Durdon | 220/254 |
| 6,260,731 | B1 | 7/2001 | Cummings | 220/717 |
| 6,260,756 | B1 | 7/2001 | Mochizuki et al. | 229/402 |
| D447,412 | S | 9/2001 | Durdon | D9/438 |
| 6,286,709 | B1 | 9/2001 | Hudson | 220/739 |
| 6,296,141 | B1 | 10/2001 | Lukacevic | 220/713 |
| 6,308,883 | B1 | 10/2001 | Schmelzer et al. | 229/403 |
| D449,986 | S | 11/2001 | Schaefer | D9/434 |
| 6,343,735 | B1 | 2/2002 | Cai | 229/117.23 |
| 6,357,619 | B1 | 3/2002 | Schaefer | 220/709 |
| 6,367,652 | B1 | 4/2002 | Toida et al. | 220/739 |
| 6,378,766 | B2 | 4/2002 | Sadlier | 229/403 |
| D457,778 | S | 5/2002 | Randolph et al. | D7/392.1 |
| 6,394,302 | B1 | 5/2002 | Query, Jr. | 220/707 |
| 6,416,829 | B2 | 7/2002 | Breining et al. | 428/34.2 |
| 6,482,481 | B1 | 11/2002 | Fredricks et al. | 428/34.2 |
| 6,505,753 | B1 | 1/2003 | Freek et al. | 220/711 |
| 6,513,379 | B2 | 2/2003 | Meyers et al. | 73/426 |
| 6,533,139 | B2 | 3/2003 | Lukacevic | 220/719 |
| 6,536,657 | B2 | 3/2003 | Van Handel | 229/403 |
| D472,424 | S | 4/2003 | Shumway et al. | D7/392.1 |
| D473,791 | S | 4/2003 | Loris | D9/447 |
| 2001/0013537 | A1 | 8/2001 | Sadlier | 229/4.5 |
| 2002/0004110 | A1 | 1/2002 | Breining et al. | 428/34.2 |
| 2002/0014524 | A1 | 2/2002 | Willis | 229/400 |
| 2002/0113072 | A1 | 8/2002 | Lane | 220/739 |
| 2002/0148832 | A1 | 10/2002 | Breining et al. | 220/62.12 |
| 2002/0148888 | A1 | 10/2002 | Kim | 229/402 |
| 2002/0150705 | A1 | 10/2002 | Breining et al. | 428/34.2 |
| 2002/0170912 | A1 | 11/2002 | Clarke | 220/254.1 |
| 2002/0172818 | A1 | 11/2002 | Debraal et al. | 428/318.4 |
| 2002/0185496 | A1 | 12/2002 | Puerini | 220/738 |
| 2002/0187286 | A1 | 12/2002 | Breining et al. | 428/34.2 |
| 2003/0015582 | A1 | 1/2003 | Handel | 229/403 |
| 2003/0021921 | A1 | 1/2003 | Debraal et al. | 428/34.2 |
| 2003/0052127 | A1 | 3/2003 | Mazzarolo | 220/254.3 |
| 2003/0089726 | A1 | 5/2003 | Mazzarolo | 220/712 |
| 2003/0141302 | A1* | 7/2003 | Ryan et al. | 220/254.1 |

* cited by examiner

FOLDABLE AIR INSULATING SLEEVE

BACKGROUND OF THE INVENTION

1. Field of the Invention

The present invention relates to insulating devices for beverage containers and more particularly, to insulating beverages and foods by using air as the insulator.

2. Background and Related Art

Disposable cups are routinely used in fast food and roadside restaurants to contain both hot and cold drinks. Because such cups have relatively thin walls, insulation is poor. As a result, the cups in which hot beverages are served are often too hot to hold comfortably, and the outside surface of cups in which cold beverages are served often accumulate moisture also making the cups difficult to hold, thus causing the holder's hand and the table to become wet. In addition, cold drinks warm quickly and hot drinks lose heat rapidly.

In response to the need for a better beverage insulator, various types of disposable cardboard and paper sleeves have been used. The sleeves are sized to slide onto the outside of a beverage cup and are held in place by friction. The wide-diameter end of the typical beverage cup prevents the sleeve from sliding off the cup while the cup is being held. However, such devices are poor insulators because they are generally thin. Moreover, the close contact with the cup causes additional heat transfer to the outside of the insulator. Additional insulation is needed at the bottom of beverage cups because the fluid has been there for a longer period of time. Also, such devices typically cover any printable material on the outside of the cup, resulting in a lost opportunity for advertising. While some transparent insulators have been created, they also lose effectiveness as insulators because of the close contact with the cups and the conductive material out of which they are typically made. Some of the more effective insulators are too bulky and take up too much storage space in small convenience stores, thus making the disposable cups too big to fit in most cup-holders. Another problem with most disposable cups is that since typical cups have narrow bases, they are unstable. Thus, there is a great need in the beverage industry for cups with better insulation and overall improvement.

To solve the problem of difficulty in gripping either hot drinks or cold drinks that accumulate moisture on the outside of the cup, some disposable cups include handles. Unfortunately, the problem with handles is that they are typically made out of paper or other sheet-like material and they lack sufficient strength to hold the cup in an upright position when the user is holding the cup by the handle. In other words, the weight of the cup can cause the handle to sag or tear such that the cup will tilt, spilling the beverage.

SUMMARY OF THE INVENTION

The present invention relates to insulating devices for beverage containers and more particularly, to insulating beverages and foods by using air as the insulator.

The preferred embodiment of the present invention involves a foldable air insulating sleeve configured to slidably receive and secure a beverage cup. The foldable air insulating sleeve secures the cup in a manner that allows for a pocket of air to surround the cup. This pocket of air insulates the beverage. The user can hold the cup by grasping the outer surface of the foldable air insulating sleeve, thus avoiding contact with a hot or wet cup surface. Because the bases of most disposable cups are narrower than their respective rims, more air and thus greater insulation is possible, especially towards the bottom of cups secured by the foldable air insulating sleeve. The wider base also gives the cup greater stability. Furthermore, the material out of which the foldable air insulating sleeve is made allows for advertisements or other printable material to be affixed on its outer surface. The foldable air insulating sleeve can be made out of many materials, including plastic or paper. The foldable air insulating sleeve is also foldable into a substantially flat position.

In this embodiment, the base of the cup rests on an inner base of the foldable air insulating sleeve. The inner base is connected to an outer base, which is in contact with the outer surface and supports the entire sleeve-cup configuration. The space between the inner and outer base is filled with air and further acts to insulate the contents of the cup.

In another embodiment, the foldable air insulating sleeve's outer base is in contact with the outer surface and supports the entire sleeve-cup configuration.

In yet another embodiment, the foldable air insulating sleeve's inner base has an opening through which the cup enters until the cup is either too wide and is stopped from further passage or until the cup meets the outer base of the foldable air insulating sleeve and is supported by it.

In even another embodiment, the foldable air insulating sleeve's outer base, while wider than the cup it supports, is narrow enough to fit into most cup holders.

In an additional embodiment, the foldable air insulating sleeve includes a lid that attaches to the top rim of the cup. The lid is substantially hollow, providing an air chamber, which further insulates the contents of the cup. When the foldable air insulating sleeve is used with food, the lid has no openings. When used with a cold drink, the lid has an opening through which a straw is placed. Finally, when used with a hot drink, the lid has a rounded mouth piece and a cap.

While the methods and processes of the present invention have proven to be particularly useful in association with beverage containers, those skilled in the art will appreciate that the methods and processes can be used in a variety of different applications to insulate a variety of different kinds of temperature sensitive substances (e.g. soups and other foods).

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to insulating devices for beverage containers, and more particularly, to insulating beverages and foods by using air as the insulator.

In the disclosure and in the claims the term "cup" shall refer to any container used to house consumable liquids and solids. Examples of cups include disposable cups, small soup bowls and any other similarly shaped container from which one drinks or eats that is in need of insulation.

Figure 1:
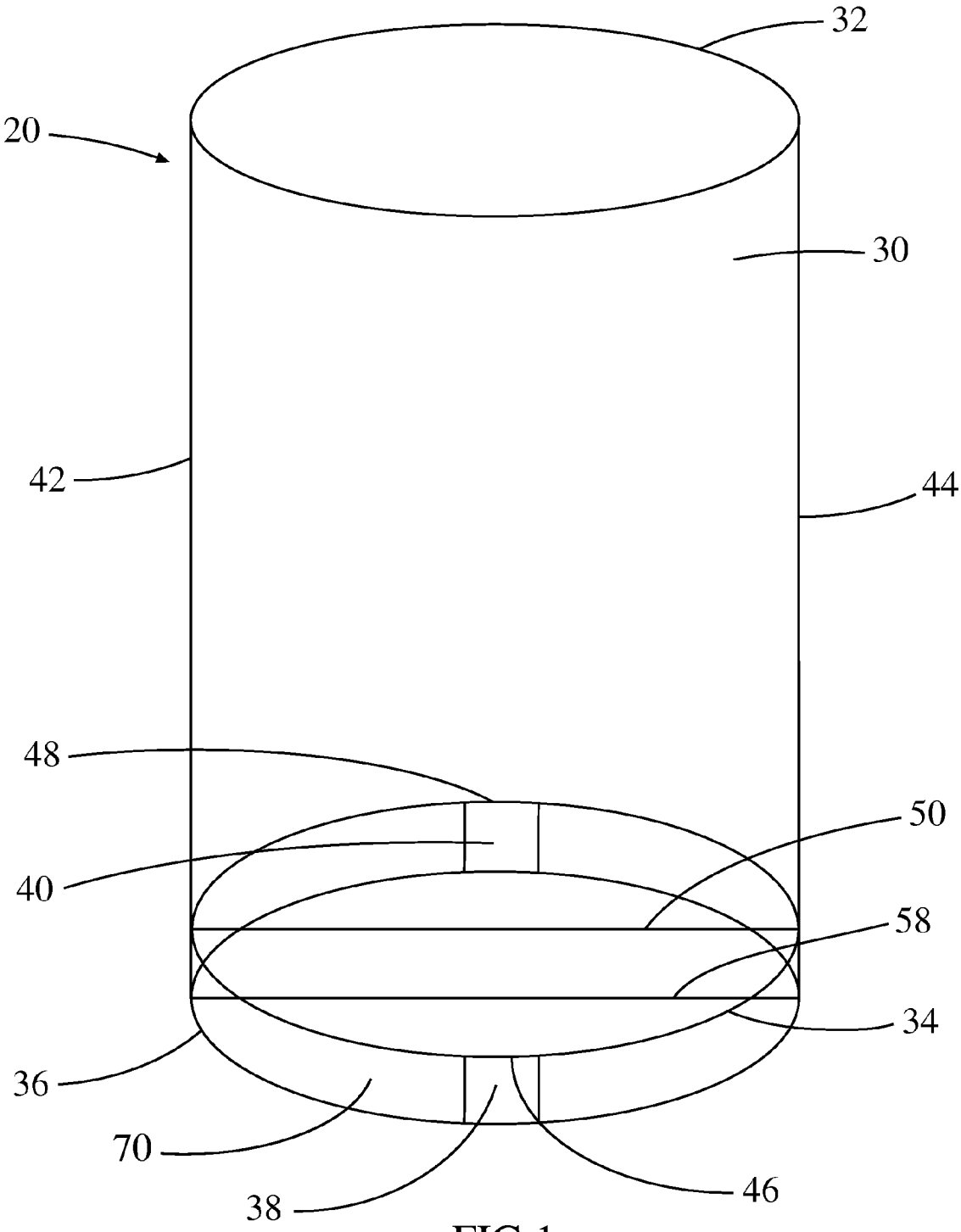
FIG. 1 provides an illustration of a representative embodiment of the present invention, wherein a foldable air insulating sleeve comprises a rim, an inner base and an outer base, where the inner base and outer base are connected.

FIG. 1 illustrates a transparent view of a foldable air insulating sleeve 20 that includes a substantially tubular outer shell 30, a rim 32, an inner base 34, an outer base 36, a first base connection strip 38 and a second base connection strip 40. The substantially tubular outer shell 30 has a first longitudinal fold 42 and a second longitudinal fold 44. The first base connection strip 38 has a first base connection strip fold 46 and the second base connection strip 40 has a second base connection strip fold 48. Finally, the inner base 34 has an inner base fold 50 and the outer base 36 has an outer base fold 58.

Figure 2:
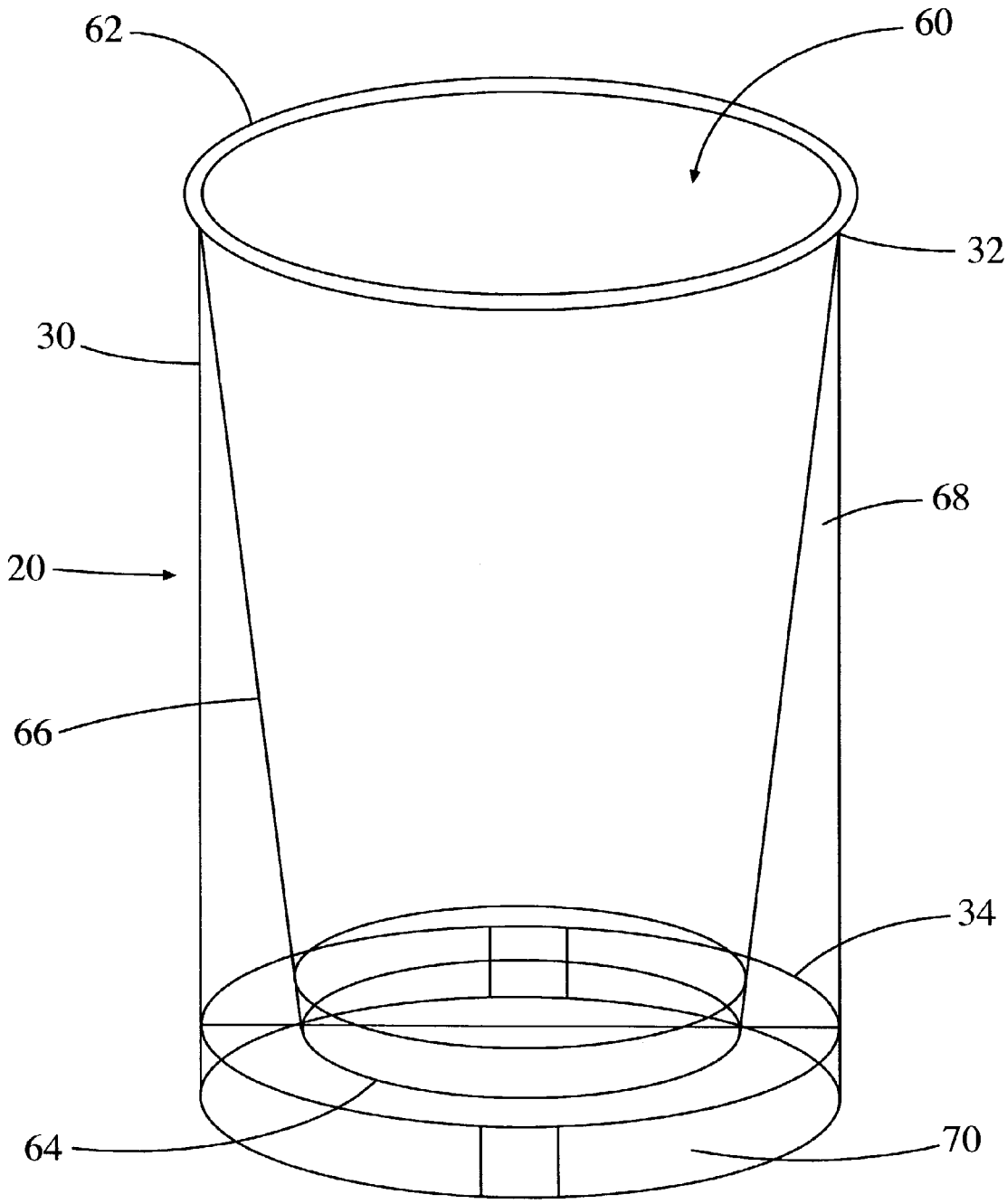
FIG. 2 provides an illustration of a representative embodiment of the present invention that houses a cup.

FIG. 2 illustrates a transparent view of foldable air insulating sleeve 20 with a cup 60, where the cup 60 has a top rim 62, a bottom edge 64 and a supporting wall 66. In the illustrated embodiment, the rim 32 of the foldable air insulating sleeve 20 connects to the top rim 62 of the cup 60. The bottom edge 64 of the cup 60 is supported by the inner base 34 of the foldable air insulating sleeve 20. Once the cup 60 is connected to the foldable air insulating sleeve 20, a first pocket of air 68 is created, which together with a second pocket of air 70, insulates the contents of the cup 60. Once connected, a user can carry the cup 60 by grasping the substantially tubular outer shell 30.

Figure 3:
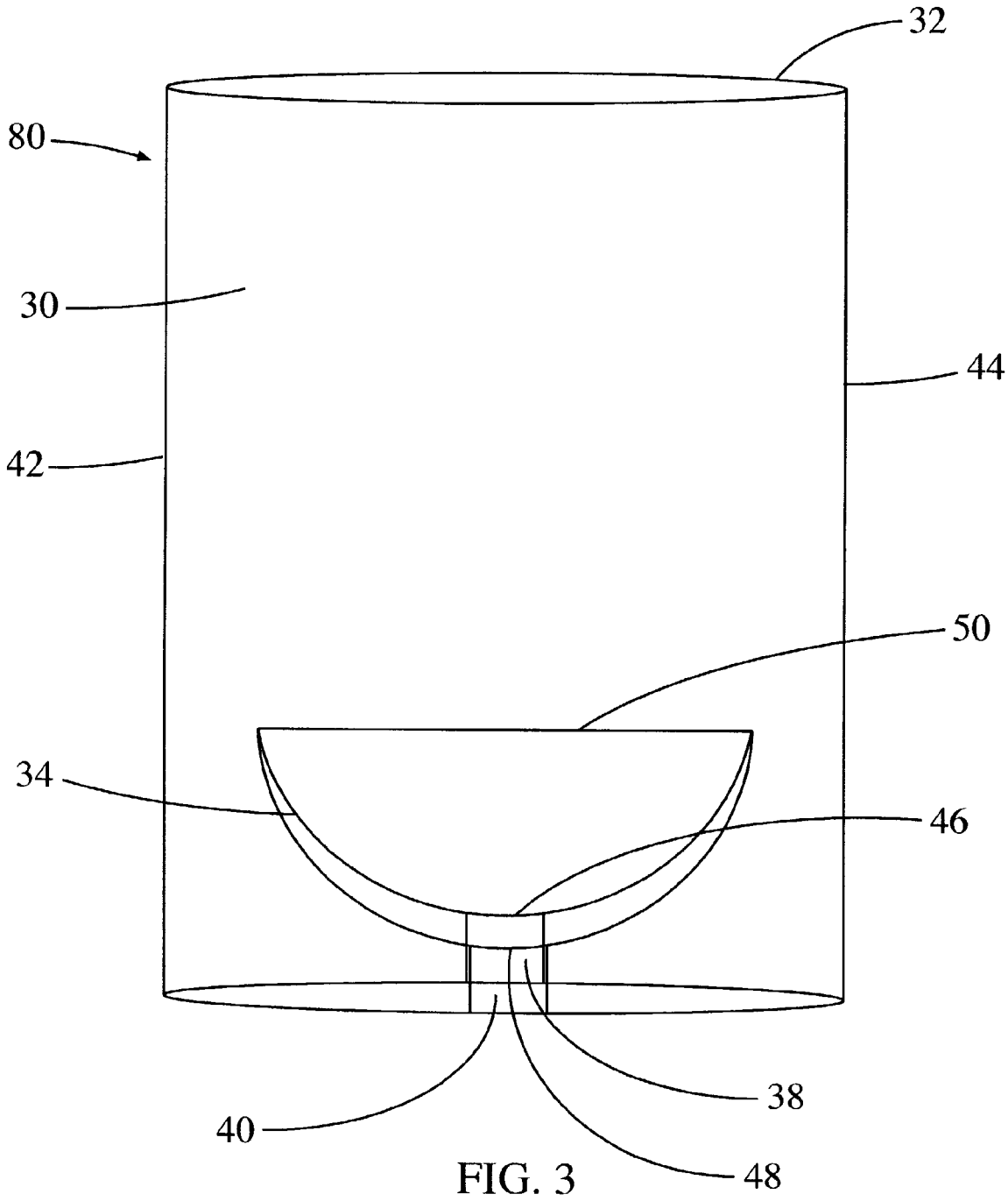
FIG. 3 provides an illustration of a representative foldable air insulating sleeve in folded position.

FIG. 3 illustrates a transparent view of a foldable air insulating sleeve in folded position 80. In this embodiment, inner base 34 is folded along inner base fold 50, first base connection strip 38 is folded along first base connection strip fold 46, second base connection strip 40 is folded along second base connection strip fold 48 and substantially tubular outer shell 30 is folded along first longitudinal fold 42 and second longitudinal fold 44 so that foldable air insulating sleeve in folded position 80 is in a substantially flat condition. When folded, the inner base fold 50 is parallel to the rim 32 and when open, the inner base fold 50 is perpendicular to the rim 32.

Figure 4:
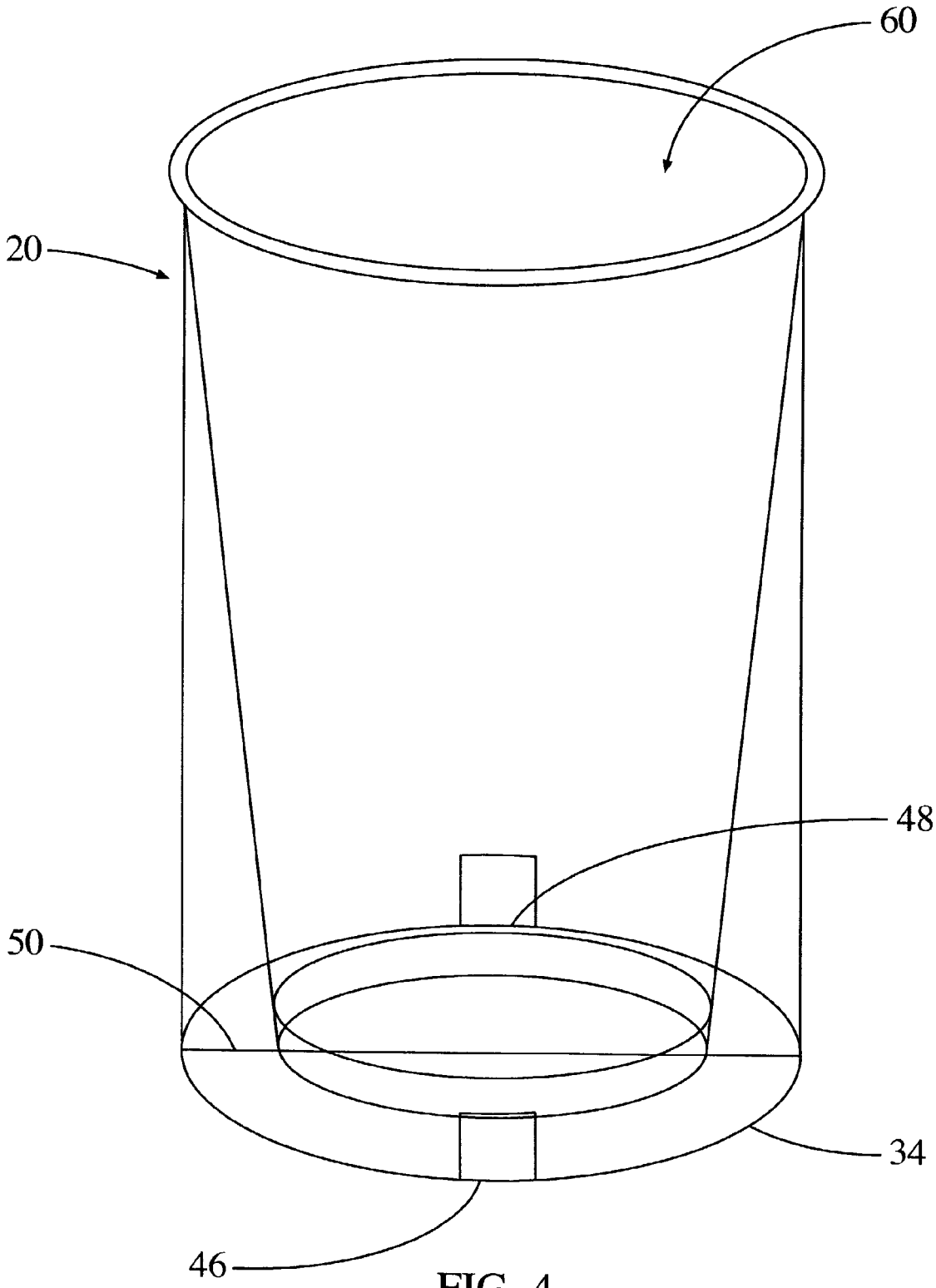
FIG. 4 provides an illustration of another representative foldable air insulating sleeve with cup where the foldable air insulating sleeve includes an inner base but no outer base.

With reference now to FIG. 4, another embodiment of the present invention is illustrated as foldable air insulating sleeve 20 with cup 60, where foldable air insulating sleeve 20 includes inner base 34 but does not include outer base 36. In this embodiment, inner base 34 supports both cup 60 and foldable air insulating sleeve 20. Inner base 34 also folds along inner base fold 50, first base connection strip fold 46 and second base connection strip fold 48.

Figure 5:
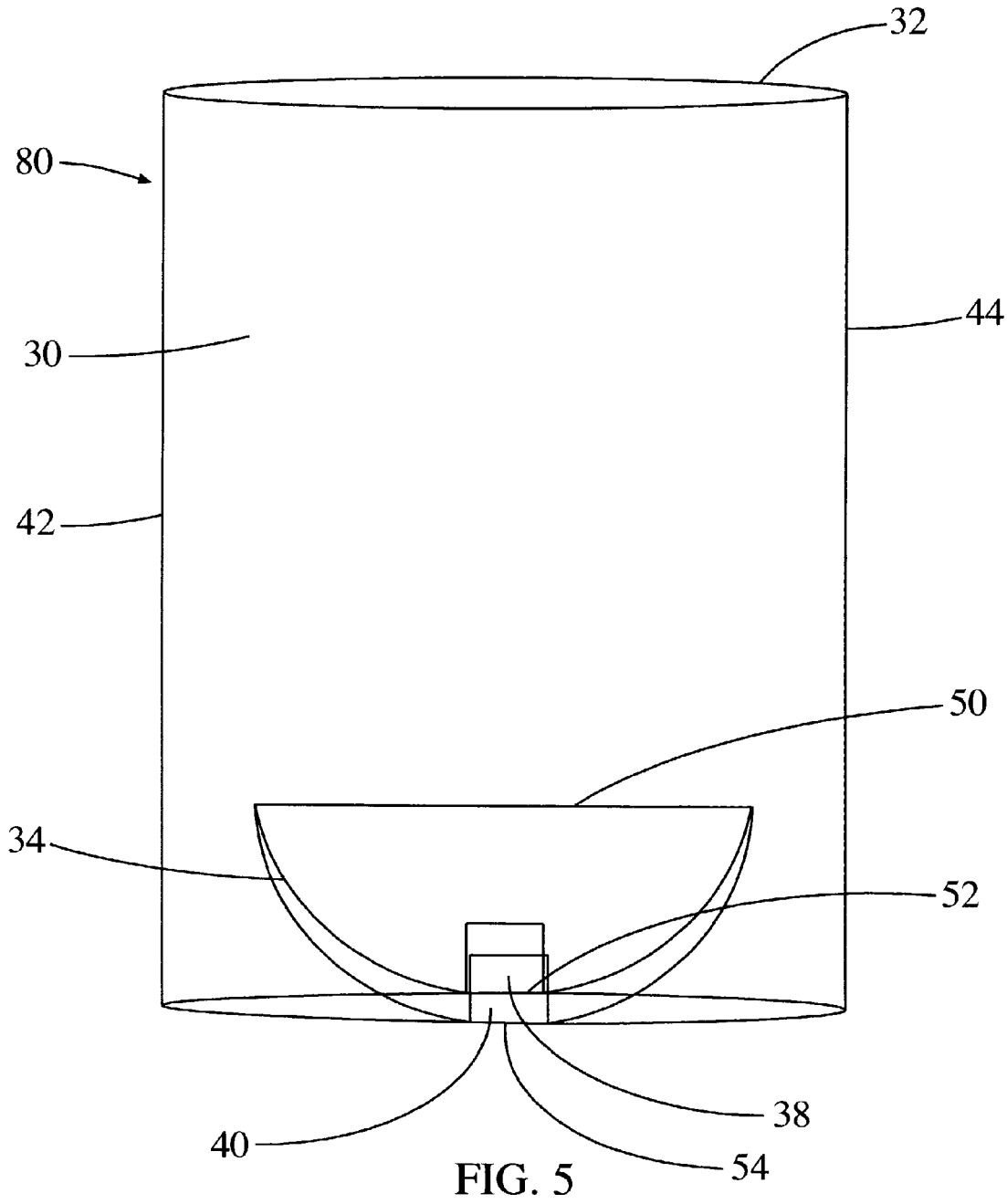
FIG. 5 shows an alternative illustration of foldable air insulating sleeve in folded position without outer base.

FIG. 5 shows an alternative illustration of foldable air insulating sleeve in folded position 80 without outer base 36. In this embodiment, inner base 34 is folded along inner base fold 50, first base connection strip 38 is folded along a first base connection strip fold line 52, second base connection strip 40 is folded along a second base connection strip fold line 54 and substantially tubular outer shell 30 is folded along first longitudinal fold 42 and second longitudinal fold 44 so that foldable air insulating sleeve in folded position 80 is in a substantially flat condition. When folded, inner base fold 50 is parallel to the rim 32 and when open, inner base fold 50 is perpendicular to rim 32.

Figure 6:
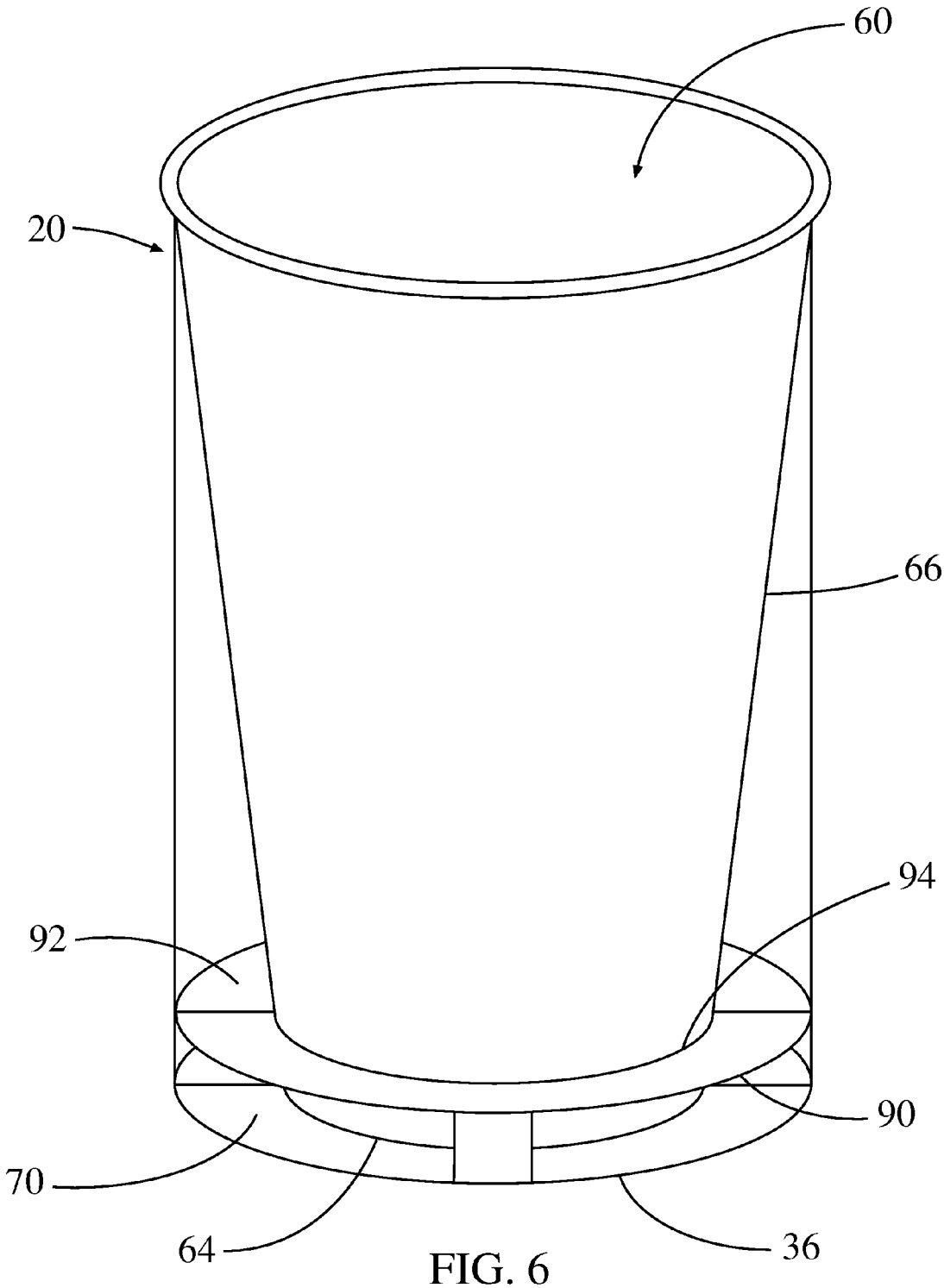
FIG. 6 provides an illustration of another representative foldable air insulating sleeve with cup that includes a modified inner base.

With reference now to FIG. 6, another embodiment of the present invention is illustrated as foldable air insulating sleeve 20 with cup 60, where foldable air insulating sleeve 20 includes modified inner base 90. Modified inner base 90 comprises a base portion 92 and an opening 94. In this embodiment, cup 60 protrudes through opening 94 until supporting wall 66 of cup 60 prohibits further travel or until bottom edge 64 of cup 60 reaches outer base 36.

Figure 7:
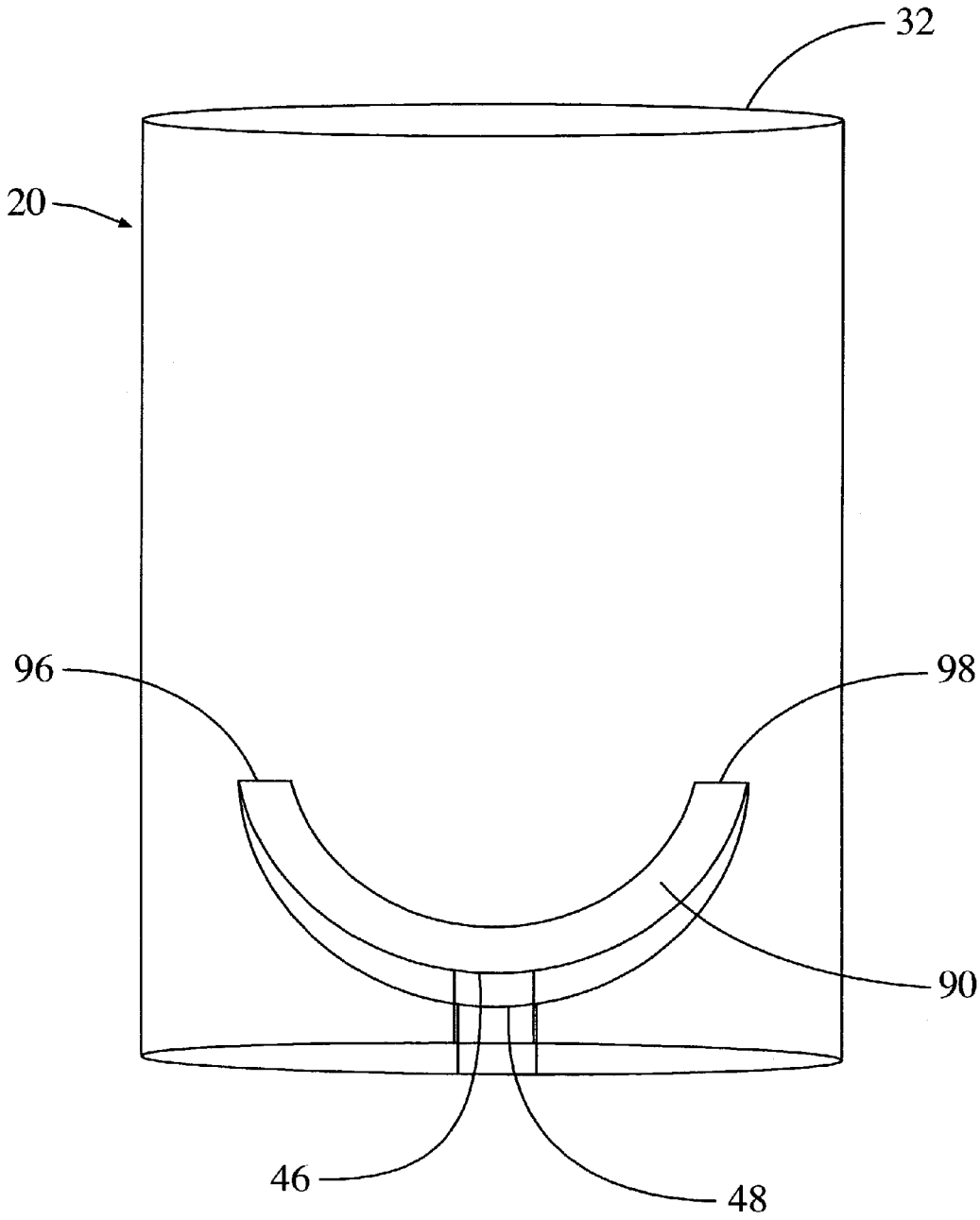
FIG. 7 provides an illustration of the foldable air insulating sleeve with modified inner base in folded position.

FIG. 7 shows foldable air insulating sleeve 20 with modified inner base 90 in folded position. Modified inner base 90 folds along first modified inner base fold 96, second modified inner base fold 98, first base connection strip fold 46 and second base connection strip fold 48. When folded, first modified inner base fold 96 and second modified inner base fold 98 are parallel to rim 32 and when open, first modified inner base fold 96 and second modified inner base fold 98 are perpendicular to rim 32.

Figure 8:
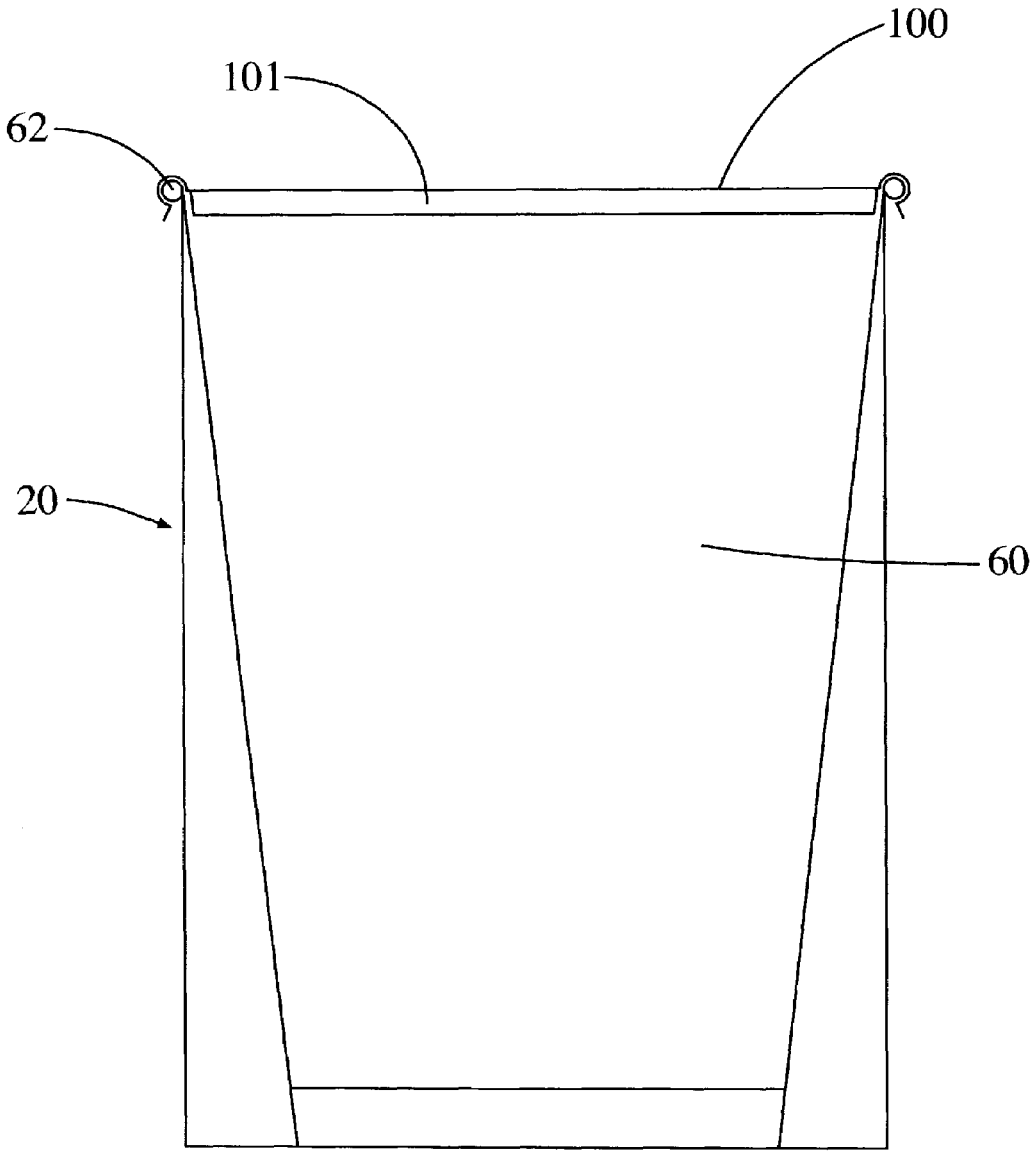
FIG. 8 provides an illustration of the foldable air insulating sleeve with a hollow food container lid.

FIG. 8 shows foldable air insulating sleeve 20 with a hollow food container lid 100 that attaches to top rim 62 of cup 60 and includes an air insulating chamber 101.

Figure 9:
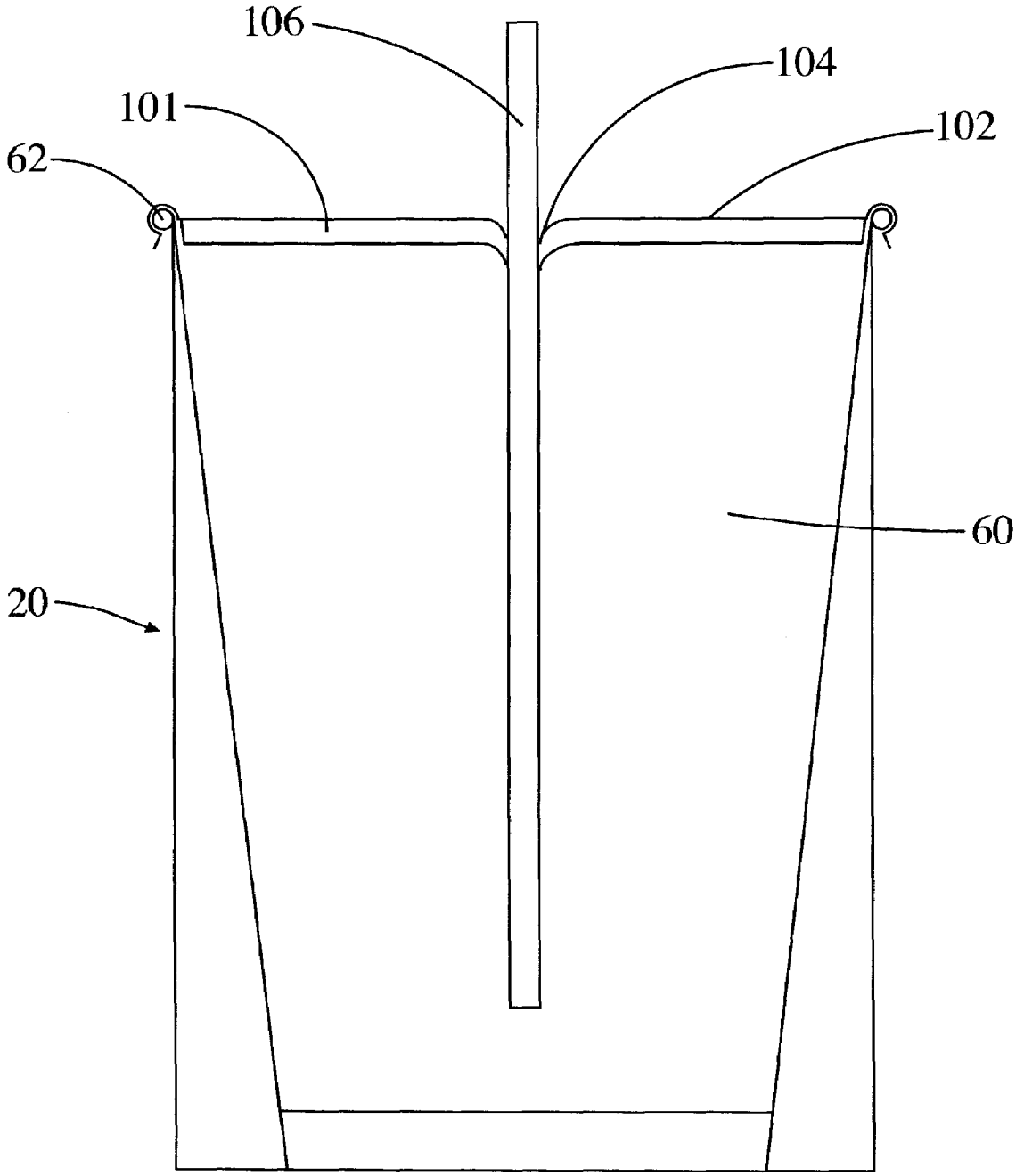
FIG. 9 provides an illustration of the foldable air insulating sleeve with a hollow cold drink lid.

FIG. 9 illustrates foldable air insulating sleeve 20 with a hollow cold drink lid 102 that attaches to top rim 62 of cup 60 and has a straw opening 104 through which a straw 106 is placed. Hollow cold drink lid 102 also includes air insulating chamber 101 that insulates contents of cup 60.

Figure 10:
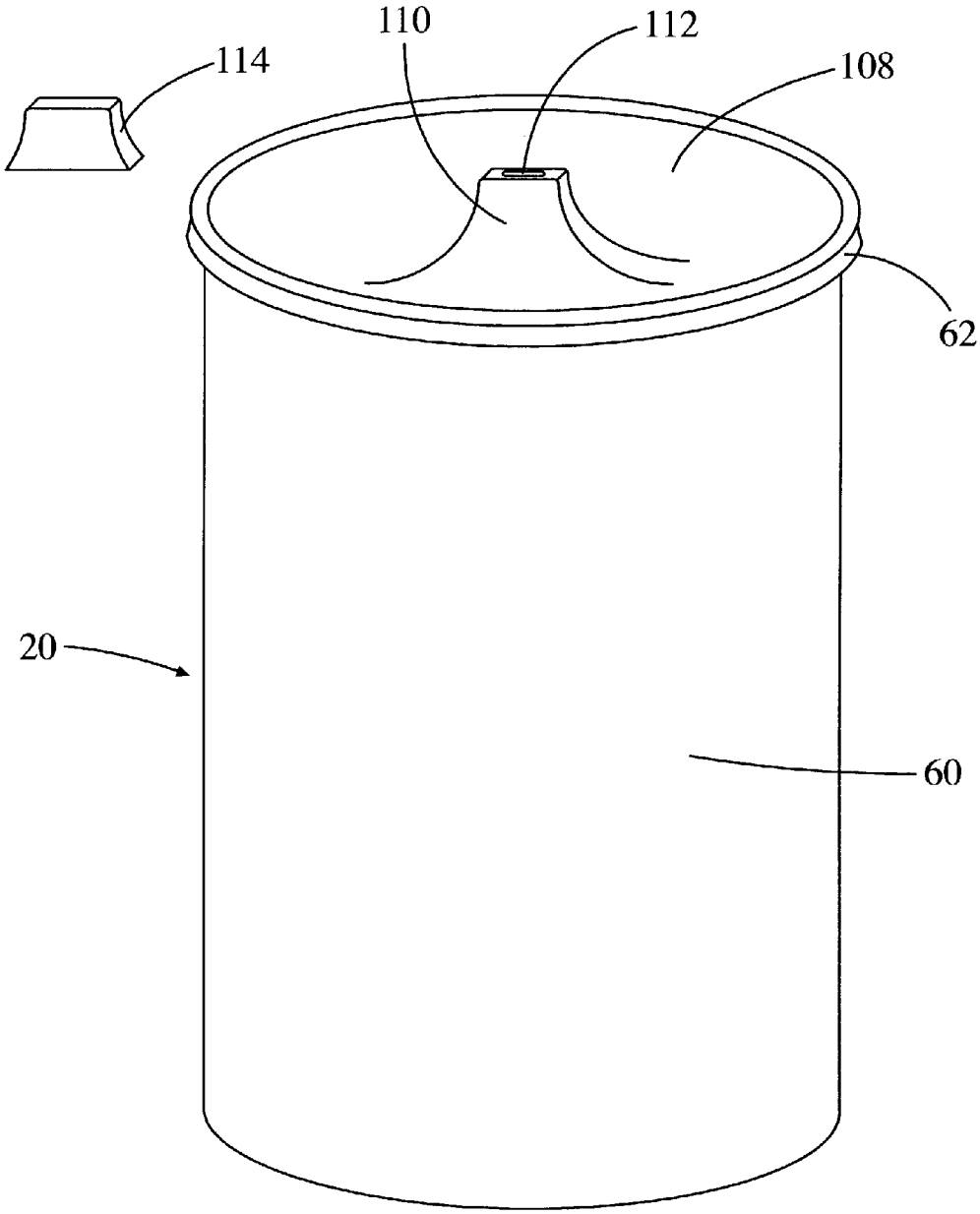
FIG. 10 provides an illustration of the foldable air insulating sleeve with a hollow hot drink lid and cap.

FIG. 10 illustrates foldable air insulating sleeve 20 with a hollow hot drink lid 108, a rounded mouth piece 110, a hollow hot drink lid opening 112 and a cap 114. Hollow hot drink lid 108 attaches to top rim 62 of cup 60. Cap 114 covers hollow hot drink lid opening 112, insulating the contents of cup 60.

Figure 11:
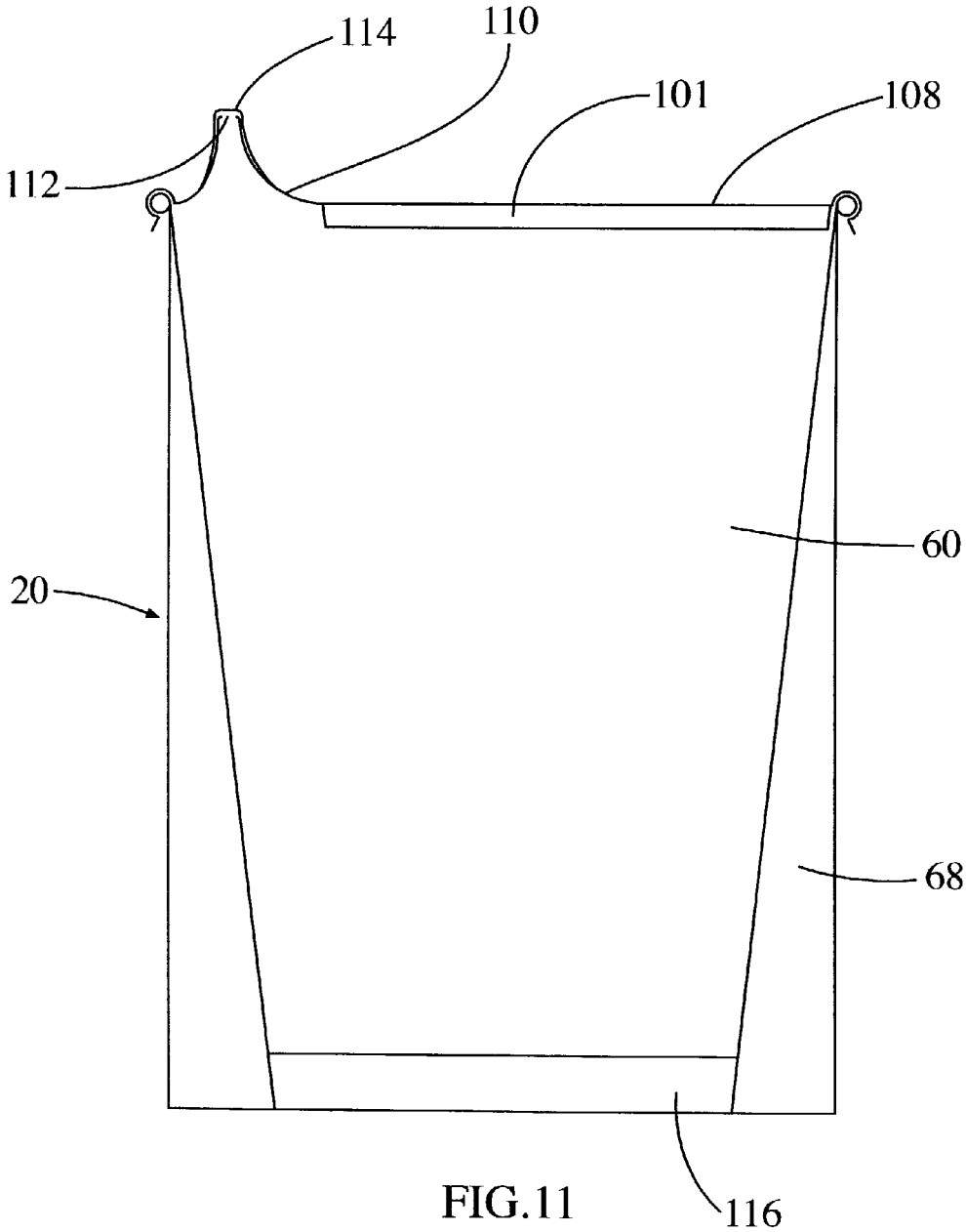
FIG. 11 provides a transparent illustration of the foldable air insulating sleeve with a hollow hot drink lid and cap.

FIG. 11 illustrates a transparent view of foldable air insulating sleeve 20 with hollow hot drink lid 108 where first pocket of air 68, insulating air chamber 101 and a third pocket of air 116 insulate the contents of cup 60. In this illustration, cap 114 is coupled to rounded mouth piece 110, covering hollow hot drink lid opening 112 and further insulating the contents of cup 60.

Figure 12:
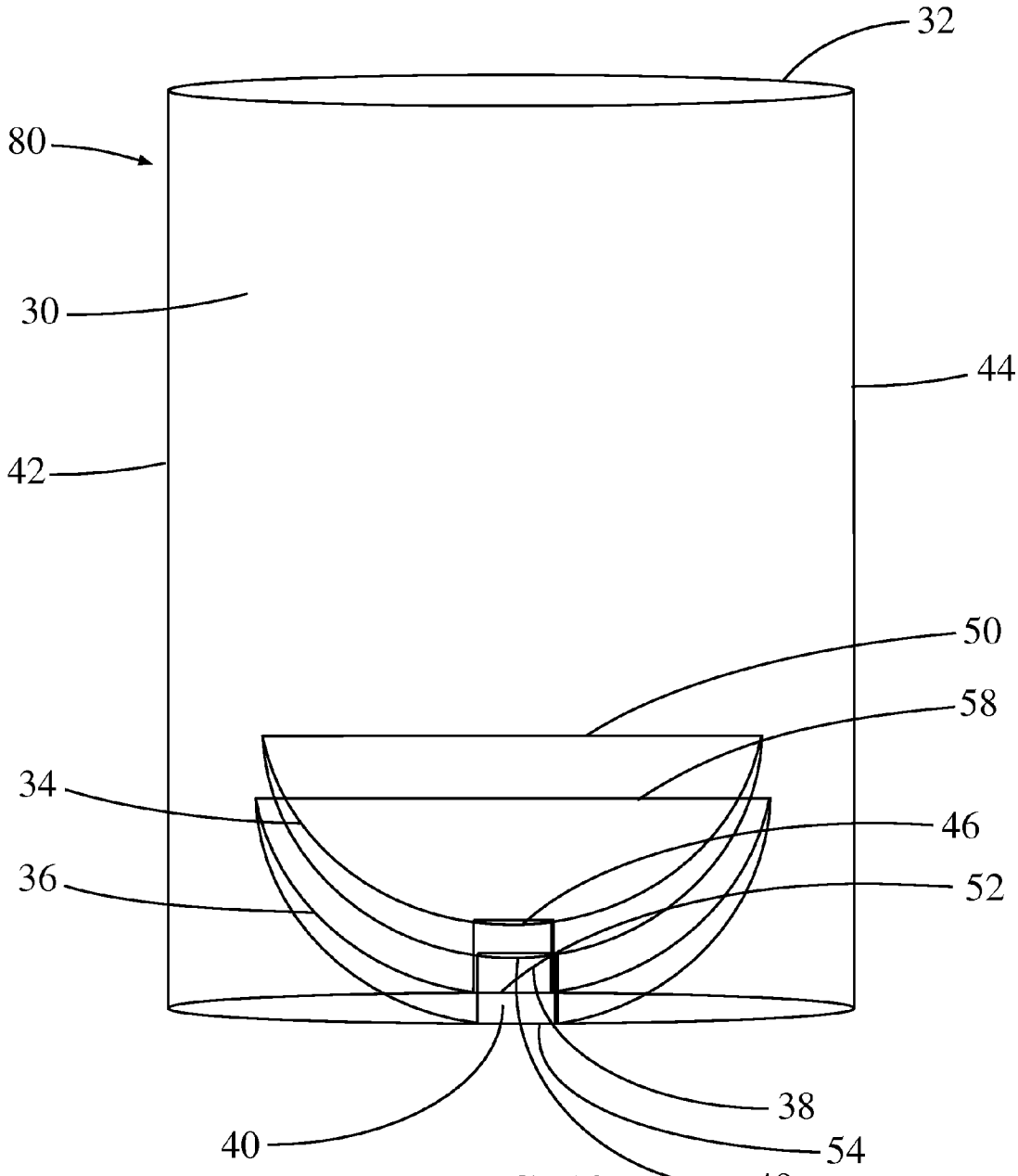
FIG. 12 provides a transparent illustration of a representative foldable air insulating sleeve in folded position.

FIG. 12 illustrates a transparent view of a foldable air insulating sleeve 20 in folded position 80. In this embodiment, inner base 34 is folded along inner base fold 50, outer base 36 is folded along outer base fold 58, first base connection strip 38 is folded along first base connection strip fold 46, second base connection strip 40 is folded along second base connection strip fold 48 and substantially tubular outer shell 30 is folded along first longitudinal fold 42 and second longitudinal fold 44 so that foldable air insulating sleeve in folded position 80 is in a substantially flat condition. When folded, the inner base fold 50 and outer base fold 58 are parallel to the rim 32 and when open, the inner base fold 50 and outer base fold 58 are perpendicular to the rim 32.

Figure 13:
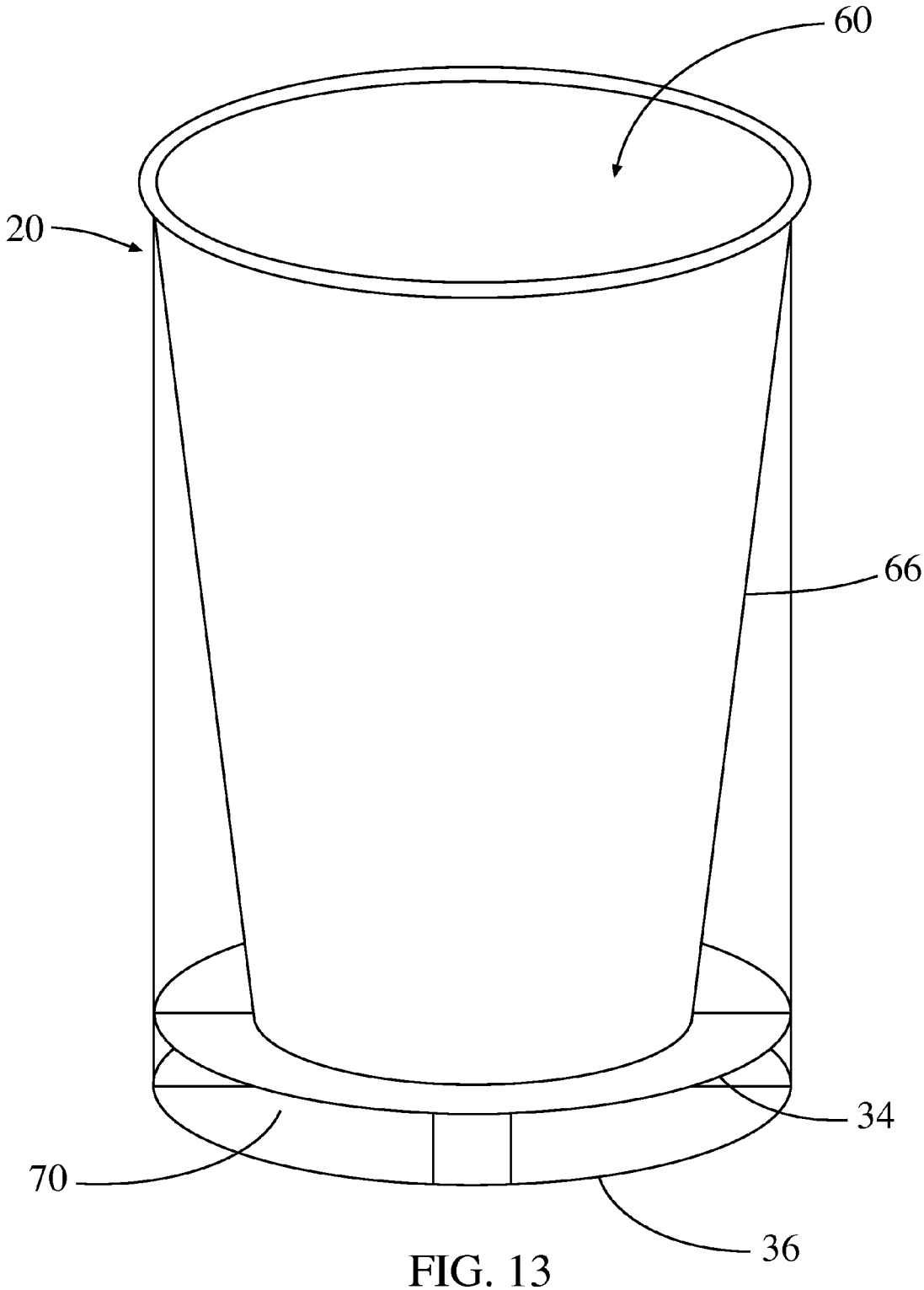
FIG. 13 provides an illustration of another representative foldable air insulating sleeve with cup.

FIG. 13 illustrates a transparent view of foldable air insulating sleeve 20 with cup 60. In this embodiment, cup 60 rests on inner base 34, and inner base 34 and outer base 36 form second pocket of air 70.

Figure 14:
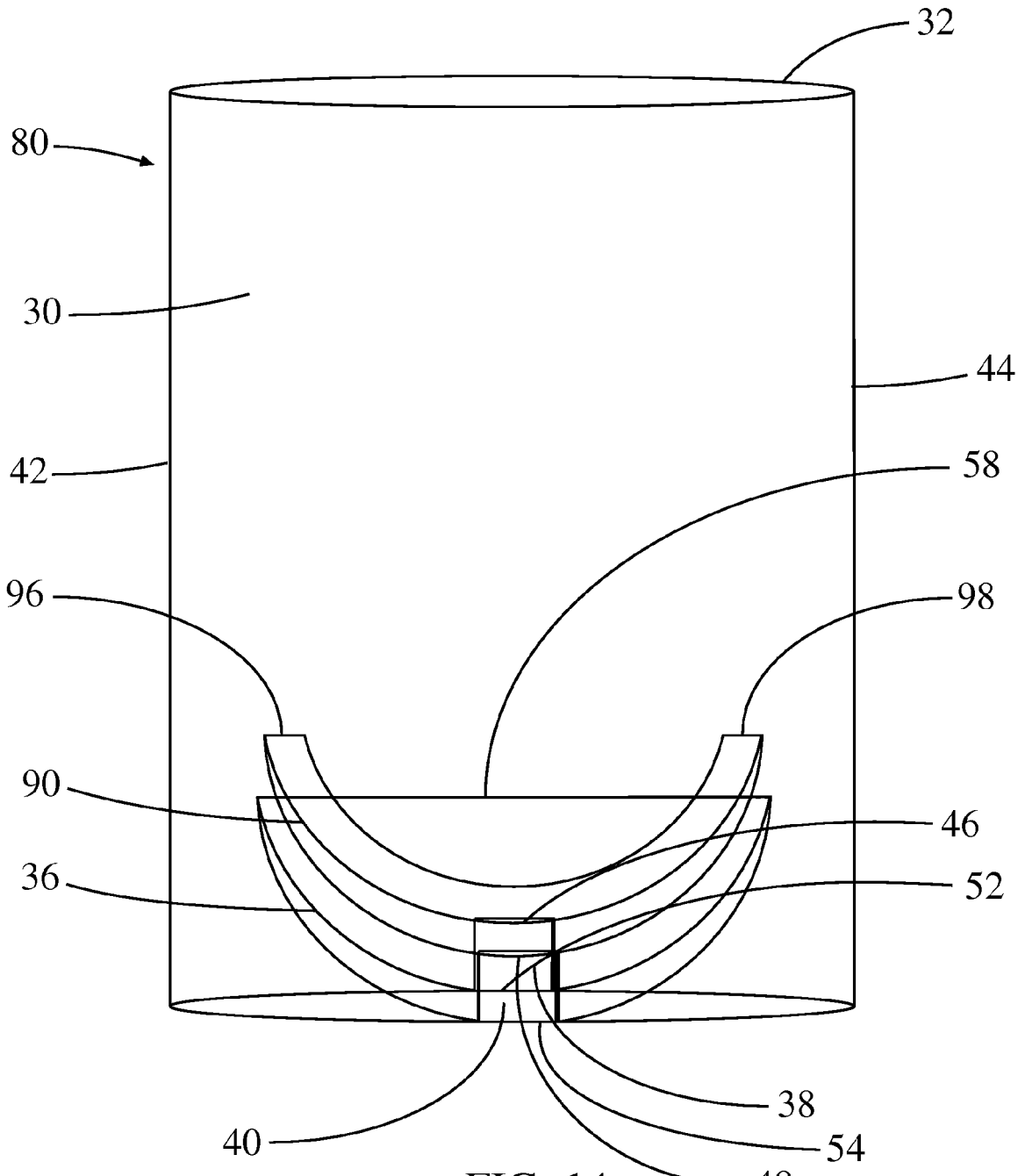
FIG. 14 provides an illustration of another representative foldable air insulating sleeve that includes a modified inner base in folded position.

FIG. 14 illustrates a transparent view of foldable air insulating sleeve 20 in folded position 80 with modified inner base 90 and outer base 36. Modified inner base 90 folds along first modified inner base fold 96, second modified inner base fold 98, first base connection strip fold 46 and second base connection strip fold 48. Outer base 36 folds along outer base fold 58, first base connection strip fold line 52, and second base connection strip fold line 54. Substantially tubular outer shell 30 is folded along first longitudinal fold 42 and second longitudinal fold 44 50 that foldable air insulating sleeve in folded position 80 is in a substantially flat condition. When folded, outer base fold 58, first modified inner base fold 96, and second modified inner base fold 98 are parallel to rim 32 and when open, outer base fold 58, first modified inner base fold 96, and second modified inner base fold 98 are perpendicular to rim 32.

Thus, as discussed herein, the embodiments of the present invention embrace the field insulating devices for beverage containers. In particular, the present invention relates to insulating disposable cups by using air as the insulator. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A foldable air insulating system, the foldable air insulating system comprising:

a cup; and a foldable air insulating sleeve configured to insulate said cup via at least a first pocket of air, said pocket of air being substantially completely enclosed by said cup and said air insulating sleeve, and said foldable air insulating sleeve comprising:

a substantially tubular outer shell;

a rim;

an inner base; and an outer base, wherein said inner base and said outer base are connected by at least one base connection strip and wherein said inner base and said outer base are separated by an air space when the foldable air insulating sleeve is in a unfolded insulating position;

wherein said substantially tubular outer shell is foldable along at least two longitudinal folds and wherein said inner base and said outer base are foldable so that said inner base and said outer base are parallel to said rim when folded and perpendicular to said rim when open and wherein said substantially tubular outer shell is foldable into a substantially flat condition; and wherein said rim of said foldable air insulating sleeve is coupled to a top rim of said cup and said inner base of said foldable insulating sleeve supports a bottom edge of said cup.

2. A foldable air insulating system as recited claim 1, wherein said foldable air insulating sleeve's inner base has an opening through which said cup enters until said cup is either too wide and is stopped from further passage or until said cup meets said outer base of said foldable air insulating sleeve.

3. A foldable air insulating system as recited claim 1, wherein said bottom edge of said cup is narrower than said top rim, causing, when coupled to said foldable air insulating sleeve, the area of said first pocket of air to be greater near said bottom edge of said cup than at said top rim.

4. A foldable air insulating system as recited claim 1, wherein said first pocket of air exists between said substantially tubular outer shell of said foldable air insulating sleeve and said cup.

5. A foldable air insulating system as recited in claim 1, wherein a second pocket of air exists between said inner base and said outer base of said foldable air insulating sleeve.

6. A foldable air insulating sleeve as recited in claim 1, wherein said foldable air insulating sleeve is made substantially out of at least one of the following materials:

i) plastic; and ii) paper.

7. A foldable air insulating system as recited claim 1, further comprising a hollow lid having an air chamber with no openings.

8. A foldable air insulating system as recited claim 1, further comprising a hollow lid having an air chamber with a straw opening.

9. A foldable air insulating system as recited in claim 7, further comprising a rounded mouth piece, a hollow hot drink lid opening and a cap.

10. A foldable air insulating system, the foldable air insulating system comprising:

a cup; and a foldable air insulating sleeve configured to receive said cup and to insulate said cup via at least a first pocket of air, said foldable air insulating sleeve comprising:

a substantially tubular outer shell having a pair of longitudinal folds on opposite sides of said outer shell;

a rim; and an inner base connected to said outer shell and having an inner base fold, wherein said pair of longitudinal folds and said inner base fold are all located in a single plane both when the foldable air insulating sleeve is in a folded position and when the foldable air insulating sleeve is in an unfolded insulating position;

an outer base;

wherein said foldable air insulating sleeve's inner base has an opening through which said cup enters until said cup is either too wide and is stopped from further passage or until said cup meets said outer base of said foldable air insulating sleeve.

11. A foldable air insulating system as recited in claim 10, wherein said outer base has an outer base fold, wherein said inner base and said outer base are connected by at least one base connection strip, and wherein said outer base fold is located in said same plane as said inner base fold and said longitudinal folds in both of said folded and said unfolded insulating positions.

12. A foldable air insulating system as recited in claim 10, wherein said bottom edge of said cup is narrower than said top rim, causing, when said cup is coupled to said foldable air insulating sleeve, the area of said first pocket of air to be greater near said bottom edge of said cup than at said top rim.

13. A foldable air insulating system, the foldable air insulating system comprising:

a cup; and a foldable air insulating sleeve configured to receive said cup and to insulate said cup via a first pocket of air and a second pocket of air, said first pocket of air being substantially completely enclosed by said cup and said foldable air insulating sleeve and said second pocket of air being substantially completely enclosed by said foldable air insulating sleeve, said foldable air insulating sleeve comprising:

a substantially tubular outer shell having a pair of longitudinal folds on opposite sides of said outer shell;

a rim;

an inner base having an inner base fold and connected to said outer shell at a pair of points distal said inner base fold; and an outer base having an outer base fold and connected to said outer shell at a pair of points distal said outer base fold;

wherein said pair of longitudinal folds, said inner base fold, and said outer base fold are all located in a single plane both when the foldable air insulating sleeve is in a folded position and when the foldable air insulating sleeve is in an unfolded insulating position and wherein said second pocket of air exists between said inner base and said outer base of said foldable air insulating sleeve.

14. A foldable air insulating system as recited in claim 13, wherein said first pocket of air exists between said substantially tubular outer shell of said foldable air insulating sleeve and said cup.

* * * * *